US009469924B1

(12) United States Patent
Wang

(10) Patent No.: US 9,469,924 B1
(45) Date of Patent: Oct. 18, 2016

(54) DIRECT PREPARATION PROCESS FOR JEANS WEAR

(71) Applicant: ADVANCE DENIM CO., LTD., Guangdong (CN)

(72) Inventor: Zongwen Wang, Guangdong (CN)

( * ) Notice: Subject to any disclaimer, the term of this patent is extended or adjusted under 35 U.S.C. 154(b) by 0 days.

(21) Appl. No.: 14/826,205

(22) Filed: Aug. 14, 2015

(30) Foreign Application Priority Data

Aug. 6, 2015 (CN) ..... 2015 1 0476338

(51) Int. Cl.

| | |
|---|---|
| ***G06F 19/00*** | (2011.01) |
| ***D04B 1/24*** | (2006.01) |
| ***D06P 3/60*** | (2006.01) |
| ***D06P 1/22*** | (2006.01) |
| ***D04B 37/02*** | (2006.01) |
| ***D04B 15/66*** | (2006.01) |

(52) U.S. Cl.
CPC ..... *D04B 1/243* (2013.01); *D04B 15/66* (2013.01); *D04B 37/02* (2013.01); *D06P 1/228* (2013.01); *D06P 3/6025* (2013.01)

(58) Field of Classification Search
CPC ..... D04B 1/243; D04B 15/66; D04B 37/02; D06P 3/6025; D06P 1/228
USPC ..... 700/130, 141
See application file for complete search history.

(56) References Cited

U.S. PATENT DOCUMENTS 4,699,627 A * 10/1987 Bailey ..... D06P 1/228 8/581
4,845,790 A * 7/1989 Brasington ..... D06B 11/0096 68/13 R
4,912,056 A * 3/1990 Olson ..... C11D 3/38645 435/188
5,006,129 A * 4/1991 Martini ..... D06P 1/44 8/529
5,310,409 A * 5/1994 Friday ..... D06P 5/153 8/102
5,505,739 A * 4/1996 Montesano ..... D06B 11/0096 26/28
5,653,770 A * 8/1997 Goldstein ..... D06B 9/02 2/69
6,251,144 B1 * 6/2001 Clarkson ..... C11D 3/38645 435/244
7,848,841 B2 * 12/2010 Piana ..... D06B 1/02 700/130
2002/0133261 A1 * 9/2002 Fard ..... D06B 11/0096 700/131
2008/0280519 A1 * 11/2008 Rodriguez ..... D06P 3/6016 442/153

* cited by examiner

*Primary Examiner* — Nathan Durham
(74) *Attorney, Agent, or Firm* — Prakash Nama Global IP Services, PLLC

(57) ABSTRACT

The invention discloses a direct preparation process for jeans wear, which comprises the following steps: a, settling cotton yarns through a fascicular warping machine; b, feeding the cotton yarns into a dyeing machine to carry out indigo dyeing; c, feeding the cotton yarns into a leaser to divide the cotton yarns; d, feeding the divided cotton yarns into an axle cone maker to obtain yarn cones; and e, placing the prepared yarn cones into an automatic knitting machine, to obtain a jeans wear. By adopting the above processing steps, the automatic knitting machine is used for directly knitting the cotton yarns prepared as the yarn cones into a jeans wear without the processes of tailoring and sewing denim fabrics in the process of preparing the jeans wear, i.e. the production process of the jeans wear can be shortened effectively, and the material loss can be effectively reduced.

10 Claims, 1 Drawing Sheet

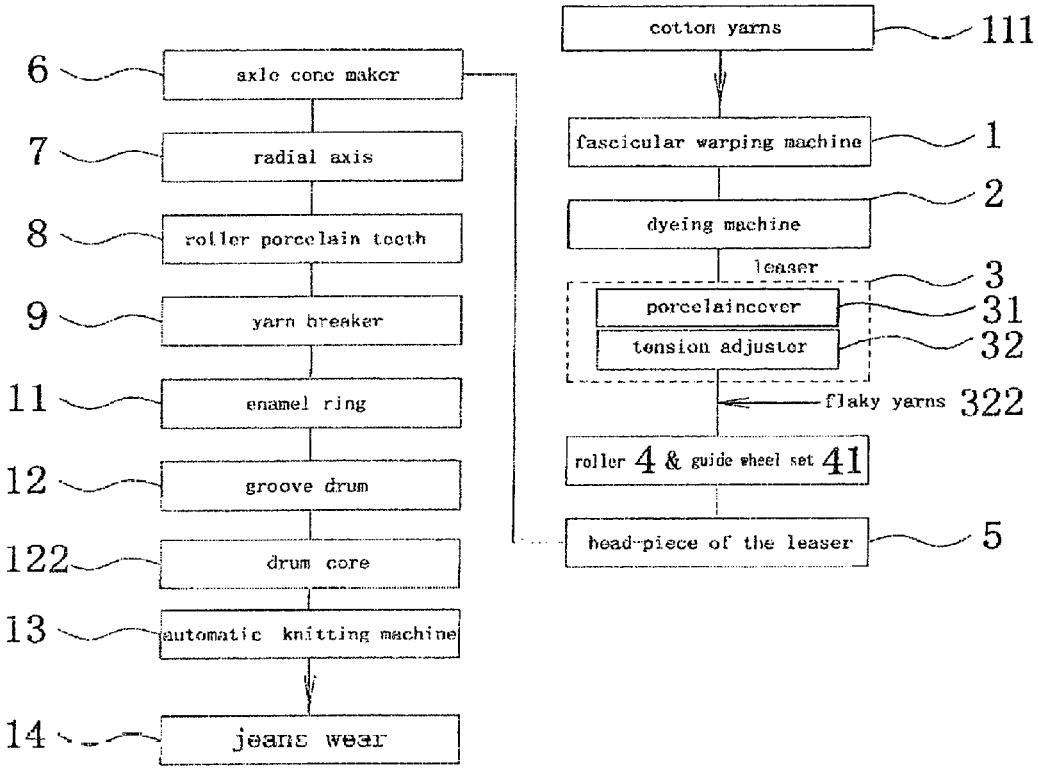
cotton yarns
111
6
axle cone maker
7
radial axis
8
roller porcelain tooth
9
yarn breaker
11
enamel ring
12
groove drum
122
drum core
13
automatic knitting machine
14
jeans wear
fascicular warping machine
1
dyeing machine
2
leaser
3
porcelaincover
31
tension adjuster
32
flaky yarns
322
roller 4 & guide wheel set 41
head-piece of the leaser
5

DIRECT PREPARATION PROCESS FOR JEANS WEAR

BACKGROUND OF THE INVENTION

The invention relates to the field of a textile technology, in particular to a direct (one-step) preparation process for a jeans wear.

A denim fabric is a coarse and thick fabric of dyed cotton yarn with twill on warp face. Warps, dark in color, are in indigo blue generally, and wefts, light in color, are raw white yarns generally, therefore the denim fabric is also called as an indigo blue fabric for labor. The denim fabric started in Western United States, and was named because the denim fabric is used for making clothes and trousers for herdsmen. A gray fabric of the denim fabric needs to be conducted for shrink resistant, so that the denim fabric is low in shrinkage rate, compact and thick in texture, colorful in lustre and distinct in weavy grain. Therefore, the denim fabric is applicable to male and female jeans, denim jackets, etc.

For existing jeans wear, the jeans wear is processed in the following way: weaving the denim fabric through knitting, and then tailoring the denim fabric, and finally sewing the tailored denim fabric into a jeans wear. The above tailored jeans wear has the defects that the process is long and the materials loss is large.

BRIEF SUMMARY OF THE INVENTION

The invention aims to provide a direct preparation process for jeans wear to remove the defects in the prior art. According to the direct preparation process for the jeans wear, the processing steps of the jeans wear can be shortened effectively, and the material loss can be effectively reduced.

In order to achieve the above object, the direct preparation process is realized by the following technical scheme.

The direct preparation process for the jeans wear, characterized by comprising the following specific processing steps:

a. Settling cotton yarns through a fascicular warping machine to complete warping process, wherein the cotton yarns are wound in parallel with 300-500 number and 500-2000 m length of cotton yarns onto a warp beam, the tension and density distribution of the warp yarns are uniform, and the warping speed is 150 m/min-200 m/min;

b. Feeding the cotton yarns after the completion of the warping into a dyeing machine to carry out indigo blue dyeing, wherein oxygen bleaching or yarn boiling on the cotton yarns are performed before the indigo blue dyeing, the cotton yarns are placed into a dye for dyeing after the preprocessing, and the dye consists of indigo powder, sodium hydrosulfite, caustic soda and water;

c. Feeding the cotton yarns after the completion of the indigo blue dyeing into a leaser to divide the cotton yarns, wherein the cotton yarns after the completion of the indigo blue dyeing are fed into the leaser through a porcelain cover of the leaser, the tension of the cotton yarns are adjusted through a tension adjuster of the leaser to meet the requirement of different numbers of cotton yarns, the cotton yarns are dispersed into flaky yarns to enter a head-piece of the leaser through the multiple twisting of a roller and the shaking of a guide wheel set, and the head-piece of the leaser is used for dividing the flaky yarns into single yarns through a reed.

d. Feeding the divided cotton yarns into the axle cone maker and making the cotton yarns into yarn cones through the axle cone maker, wherein the divided cotton yarns are wound on a radial axis, the radial axis is fed into the axle cone maker and the cotton yarns are drawn out, the drawn out cotton yarns are dispersed into single yarns through roller porcelain teeth, a yarn breaker and an enamel ring, and the single yarns are wound on a drum core through a groove drum;

e. Placing the prepared yarn cones on the automatic knitting machine, and knitting the cotton yarns into a jeans wear through the automatic knitting machine.

In which, the automatic knitting machine is a computerized flat knitter.

In which, the automatic knitting machine is a computerized circular knitting machine.

In which, the weight ratio of the indigo powder to the sodium hydrosulfite to the caustic soda in step b is 1: 0.8: 0.7.

In which, the dye in the step b consists of the following specific materials in parts by weight:

The indigo powder: 1-6%;
The sodium hydrosulfite: 0.8-4.8%;
The caustic soda: 0.7-4.2%;
The allowance is water.

In which, the dye in the step b consists of the following specific materials in parts by weight:

The indigo powder: 2-5%;
The sodium hydrosulfite: 1.6-4%;
The caustic soda: 1.4-3.5%;
The allowance is water.

In which, the dye in the step b consists of the following specific materials in parts by weight:

The indigo powder: 3-4%;
The sodium hydrosulfite: 2.4-3.2%;
The caustic soda: 2.1-2.8%;
The allowance is water.

In which, the dye in the step b consists of the following specific materials in parts by weight:

The indigo powder: 3.5%;
The sodium hydrosulfite: 2.8%;
The caustic soda: 2.45%;
The allowance is water.

In which, the dye in the step b consists of the following specific materials in parts by weight:

The indigo powder: 4%;
The sodium hydrosulfite: 3.2%;
The caustic soda: 2.8%;
The allowance is water.

In which, the warping speed is 160 m/min-180 m/min in the step a.

The invention has the beneficial effects that the direct preparation process has the following specific steps: a, settling cotton yarns through the fascicular warping machine to complete warping process; b, feeding the cotton yarns after the completion of the warping into the dyeing machine to carry out indigo blue dyeing; c, feeding the cotton yarns after the completion of the indigo blue dyeing into the leaser to divide the cotton yarns; d, feeding the divided cotton yarns into the axle cone maker and making the cotton yarns into yarn cones through the axle cone maker; and e, placing the prepared yarn cones on an automatic knitting machine, and knitting the cotton yarns into a jeans wear through the automatic knitting machine. By adopting the design of the above processing steps, the automatic knitting machine is used for directly knitting the cotton yarns prepared as the yarn cones into a jeans wear without the processes of tailoring and sewing denim fabrics in the process of preparing the jeans wear, i.e. the production process of the jeans wear can be shortened effectively, and the material loss can be effectively reduced.

BRIEF DESCRIPTION OF THE DRAWING(S)

FIG. 1 is a block diagram showing a process of preparing jeans wear according to the present invention.

DETAILED DESCRIPTION OF THE INVENTION

A direct preparation process for jeans wear provided by the invention is further specified in details by combining the specific embodiments.

In the embodiment I, a direct preparation process for jeans wear comprises the following specific steps:

a, Settling cotton yarns 111 through a fascicular warping machine 1 to complete warping process, wherein the cotton yarns are wound in parallel with 500 number and 2000 m length of cotton yarns onto a warp beam, the tension and density distribution of the warp yarns are uniform, and the warping speed is 150 m/min-200 m/min;

the cotton yarns are wound in parallel with certain number and specified length of cotton yarns onto a warp beam, the tension and density distribution of the warp yarns are uniform, and the warping speed is 150 m/min-200 m/min;

b. Feeding the cotton yarns after the completion of the warping into a dyeing machine 2 to carry out indigo blue dyeing, wherein oxygen bleaching or yarn boiling on the cotton yarns are performed before the indigo blue dyeing, the cotton yarns are placed into a dye for dyeing after the preprocessing, and the dye consists of indigo powder, sodium hydrosulfite, caustic soda and water, wherein the weight ratio of the indigo powder to the sodium hydrosulfite to the caustic soda is 1: 0.8: 0.7, and the dye comprises the four materials in parts by weight: 3.5% of indigo powder, 2.8% of sodium hydrosulfite, 2.45% of caustic soda and the allowance of water;

c. Feeding the cotton yarns after the completion of the indigo blue dyeing into a leaser 3 to divide the cotton yarns, wherein the cotton yarns after the completion of the indigo blue dyeing are fed into the leaser through a porcelain cover 31 of the leaser, the tension of the cotton yarns are adjusted through a tension adjuster 32 of the leaser to meet the requirement of different numbers of cotton yarns, the cotton yarns are dispersed into flaky yarns 322 to enter a head-piece 5 of the leaser through the multiple twisting of a roller 4 and the shaking of a guide wheel set 41 , and the head-piece of the leaser is used for dividing the flaky yarns into single yarns through a reed.

d. Feeding the divided cotton yarns into the axle cone maker 6 and making the cotton yarns into yarn cones through the axle cone maker, wherein the divided cotton yarns are wound on a radial axis 7, the radial axis is fed into the axle cone maker and the cotton yarns are drawn out, the drawn out cotton yarns are dispersed into single yarns through roller porcelain teeth 8, a yarn breaker 9 and an enamel ring 11, and the single yarns are wound on a drum core 122 through a groove drum 12;

e. Placing the prepared yarn cones on the computerized flat knitter being an automatic knitting machine 13, and knitting the cotton yarns into a jeans wear 14 through the computerized flat knitter.

In the embodiment I, by adopting the design of the above processing steps, the computerized flat knitter is used for directly knitting the cotton yarns prepared as the yarn cones into a jeans wear without the processes of tailoring and sewing the denim fabrics in the process of preparing the jeans wear, i.e. the production process of the jeans wear can be shortened effectively, and the material loss can be effectively reduced in the embodiment I.

In the embodiment II, a direct preparation process for jeans wear, characterized by comprising the following processing steps:

a. Settling cotton yarns through a fascicular warping machine to complete warping process, wherein the cotton yarns are wound in parallel with certain number and specified length of cotton yarns onto a warp beam, the tension and density distribution of the warp yarns are uniform, and the warping speed is 160 m/min;

b. Feeding the cotton yarns after the completion of the warping into a dyeing machine to carry out indigo blue dyeing, wherein oxygen bleaching or yarn boiling on the cotton yarns are performed before the indigo blue dyeing, the cotton yarns are placed into a dye for dyeing after the preprocessing, and the dye consists of indigo powder, sodium hydrosulfite, caustic soda and water, wherein the weight ratio of the indigo powder to the sodium hydrosulfite to the caustic soda is 1: 0.8: 0.7, and the dye comprises the four materials in parts by weight: 4% of indigo powder, 3.2% of sodium hydrosulfite, 2.8% of caustic soda and the allowance of water;

c. Feeding the cotton yarns after the completion of the indigo blue dyeing into a leaser to divide the cotton yarns, wherein the cotton yarns after the completion of the indigo blue dyeing are fed into the leaser through a porcelain cover of the leaser, the tension of the cotton yarns are adjusted through a tension adjuster of the leaser to meet the requirement of different numbers of cotton yarns, the cotton yarns are dispersed into flaky yarns to enter a head-piece of the leaser through the multiple twisting of a roller and the shaking of a guide wheel set, and the head-piece of the leaser is used for dividing the flaky yarns into single yarns through a reed.

d. Feeding the divided cotton yarns into the axle cone maker and making the cotton yarns into yarn cones through the axle cone maker, wherein the divided cotton yarns are wound on a radial axis, the radial axis is fed into the axle cone maker and the cotton yarns are drawn out, the drawn out cotton yarns are dispersed into single yarns through roller porcelain teeth, a yarn breaker and an enamel ring, and the single yarns are wound on a drum core through a groove drum;

e. Placing the prepared yarn cones on the computerized flat knitter, and knitting the cotton yarns into a jeans wear through the computerized flat knitter.

In the embodiment II, by adopting the design of the above processing steps, the computerized flat knitter is used for directly knitting the cotton yarns prepared as the yarn cones into a jeans wear without the processes of tailoring and sewing denim fabrics in the process of preparing the jeans wear, i.e. the production process of the jeans wear can be shortened effectively, and the material loss can be effectively reduced in the embodiment II.

In the embodiment III, a direct preparation process for jeans wear, characterized by comprising the following processing steps:

a. Settling cotton yarns through a fascicular warping machine to complete warping process, wherein the cotton yarns are wound in parallel with 400 number and 1500 m length of cotton yarns onto a warp beam, the tension and density distribution of the warp yarns are uniform, and the warping speed is 170 m/min;

b. Feeding the cotton yarns after the completion of the warping into a dyeing machine to carry out indigo blue dyeing, wherein oxygen bleaching or yarn boiling on the cotton yarns are performed before the indigo blue dyeing, the cotton yarns are placed into a dye for dyeing after the preprocessing, and the dye consists of indigo powder, sodium hydrosulfite, caustic soda and water, wherein the weight ratio of the indigo powder to the sodium hydrosulfite to the caustic soda is 1: 0.8: 0.7, and the dye comprises the four materials in parts by weight: 1% of indigo powder, 0.8% of sodium hydrosulfite, 0.7% of caustic soda and the allowance of water;

c. Feeding the cotton yarns after the completion of the indigo blue dyeing into a leaser to divide the cotton yarns, wherein the cotton yarns after the completion of the indigo blue dyeing are fed into the leaser through a porcelain cover of the leaser, the tension of the cotton yarns are adjusted through a tension adjuster of the leaser to meet the requirement of different numbers of cotton yarns, the cotton yarns are dispersed into flaky yarns to enter a head-piece of the leaser through the multiple twisting of a roller and the shaking of a guide wheel set, and the head-piece of the leaser is used for dividing the flaky yarns into single yarns through a reed.

d. Feeding the divided cotton yarns into the axle cone maker and making the cotton yarns into yarn cones through the axle cone maker, wherein the divided cotton yarns are wound on a radial axis, the radial axis is fed into the axle cone maker and the cotton yarns are drawn out, the drawn out cotton yarns are dispersed into single yarns through roller porcelain teeth, a yarn breaker and an enamel ring, and the single yarns are wound on a drum core through a groove drum;

e. Placing the prepared yarn cones on the computerized flat knitter, and knitting the cotton yarns into a jeans wear through the computerized flat knitter.

In the embodiment III, by adopting the design of the above processing steps, the computerized flat knitter is used for directly knitting the cotton yarns prepared as the yarn cones into a jeans wear without the processes of tailoring and sewing denim fabrics in the process of preparing the jeans wear, i.e. the production process of the jeans wear can be shortened effectively, and the material loss can be effectively reduced in the embodiment III.

In the embodiment IV, a direct preparation process for jeans wear, characterized by comprising the following processing steps:

a. Settling cotton yarns through a fascicular warping machine to complete warping process, wherein the cotton yarns are wound in parallel with 300 number and 1500 m length of cotton yarns onto a warp beam, the tension and density distribution of the warp yarns are uniform, and the warping speed is 180 m/min;

b. Feeding the cotton yarns after the completion of the warping into a dyeing machine to carry out indigo blue dyeing, wherein oxygen bleaching or yarn boiling on the cotton yarns are performed before the indigo blue dyeing, the cotton yarns are placed into a dye for dyeing after the preprocessing, and the dye consists of indigo powder, sodium hydrosulfite, caustic soda and water, wherein the weight ratio of the indigo powder to the sodium hydrosulfite to the caustic soda is 1: 0.8: 0.7, and the dye comprises the four materials in parts by weight: 6% of indigo powder, 4.8% of sodium hydrosulfite, 4.2% of caustic soda and the allowance of water;

c. Feeding the cotton yarns after the completion of the indigo blue dyeing into a leaser to divide the cotton yarns, wherein the cotton yarns after the completion of the indigo blue dyeing are fed into the leaser through a porcelain cover of the leaser, the tension of the cotton yarns are adjusted through a tension adjuster of the leaser to meet the requirement of different numbers of cotton yarns, the cotton yarns are dispersed into flaky yarns to enter a head-piece of the leaser through the multiple twisting of a roller and the shaking of a guide wheel set, and the head-piece of the leaser is used for dividing the flaky yarns into single yarns through a reed.

d. Feeding the divided cotton yarns into the axle cone maker and making the cotton yarns into yarn cones through the axle cone maker, wherein the divided cotton yarns are wound on a radial axis, the radial axis is fed into the axle cone maker and the cotton yarns are drawn out, the drawn out cotton yarns are dispersed into single yarns through roller porcelain teeth, a yarn breaker and an enamel ring, and the single yarns are wound on a drum core through a groove drum;

e. Placing the prepared yarn cones on the computerized flat knitter, and knitting the cotton yarns into a jeans wear through the computerized flat knitter.

In the embodiment IV, by adopting the design of the above processing steps, the computerized flat knitter is used for directly knitting the cotton yarns prepared as the yarn cones into a jeans wear without the processes of tailoring and sewing denim fabrics in the process of preparing the jeans wear, i.e. the production process of the jeans wear can be shortened effectively, and the material loss can be effectively reduced in the embodiment IV.

In the embodiment V, a direct preparation process for jeans wear, characterized by comprising the following processing steps:

a. Settling cotton yarns through a fascicular warping machine to complete warping process, wherein the cotton yarns are wound in parallel with 600 number and 1000 m length of cotton yarns onto a warp beam, the tension and density distribution of the warp yarns are uniform, and the warping speed is 200 m/min;

b. Feeding the cotton yarns after the completion of the warping into a dyeing machine to carry out indigo blue dyeing, wherein oxygen bleaching or yarn boiling on the cotton yarns are performed before the indigo blue dyeing, the cotton yarns are placed into a dye for dyeing after the preprocessing, and the dye consists of indigo powder, sodium hydrosulfite, caustic soda and water, wherein the weight ratio of the indigo powder to the sodium hydrosulfite to the caustic soda is 1: 0.8: 0.7, and the dye comprises the four materials in parts by weight: 5% of indigo powder, 4% of sodium hydrosulfite, 3.5% of caustic soda and the allowance of water;

c. Feeding the cotton yarns after the completion of the indigo blue dyeing into a leaser to divide the cotton yarns, wherein the cotton yarns after the completion of the indigo blue dyeing are fed into the leaser through a porcelain cover of the leaser, the tension of the cotton yarns are adjusted through a tension adjuster of the leaser to meet the requirement of different numbers of cotton yarns, the cotton yarns are dispersed into flaky yarns to enter a head-piece of the leaser through the multiple twisting of a roller and the shaking of a guide wheel set, and the head-piece of the leaser is used for dividing the flaky yarns into single yarns through a reed.

d. Feeding the divided cotton yarns into the axle cone maker and making the cotton yarns into yarn cones through the axle cone maker, wherein the divided cotton yarns are wound on a radial axis, the radial axis is fed into the axle cone maker and the cotton yarns are drawn out, the drawn out cotton yarns are dispersed into single yarns through roller porcelain teeth, a yarn breaker and an enamel ring, and the single yarns are wound on a drum core through a groove drum;

e. Placing the prepared yarn cones on the computerized flat knitter, and knitting the cotton yarns into a jeans wear through the computerized flat knitter.

In the embodiment V, by adopting the design of the above processing steps, the computerized flat knitter is used for directly knitting the cotton yarns prepared as the yarn cones into a jeans wear without the processes of tailoring and sewing denim fabrics in the process of preparing the jeans wear, i.e. the production process of the jeans wear can be shortened effectively, and the material loss can be effectively reduced in the embodiment V.

In the embodiment VI, a direct preparation process for jeans wear, characterized by comprising the following processing steps:

a. Settling cotton yarns through a fascicular warping machine to complete warping process, wherein the cotton yarns are wound in parallel with 400 number and 2000 m length of cotton yarns onto a warp beam, the tension and density distribution of the warp yarns are uniform, and the warping speed is 150 m/min;

b. Feeding the cotton yarns after the completion of the warping into a dyeing machine to carry out indigo blue dyeing, wherein oxygen bleaching or yarn boiling on the cotton yarns are performed before the indigo blue dyeing, the cotton yarns are placed into a dye for dyeing after the preprocessing, and the dye consists of indigo powder, sodium hydrosulfite, caustic soda and water, wherein the weight ratio of the indigo powder to the sodium hydrosulfite to the caustic soda is 1: 0.8: 0.7, and the dye comprises the four materials in parts by weight: 3.5% of indigo powder, 2.8% of sodium hydrosulfite, 2.45% of caustic soda and the allowance of water;

c. Feeding the cotton yarns after the completion of the indigo blue dyeing into a leaser to divide the cotton yarns, wherein the cotton yarns after the completion of the indigo blue dyeing are fed into the leaser through a porcelain cover of the leaser, the tension of the cotton yarns are adjusted through a tension adjuster of the leaser to meet the requirement of different numbers of cotton yarns, the cotton yarns are dispersed into flaky yarns to enter a head-piece of the leaser through the multiple twisting of a roller and the shaking of a guide wheel set, and the head-piece of the leaser is used for dividing the flaky yarns into single yarns through a reed.

d. Feeding the divided cotton yarns into the axle cone maker and making the cotton yarns into yarn cones through the axle cone maker, wherein the divided cotton yarns are wound on a radial axis, the radial axis is fed into the axle cone maker and the cotton yarns are drawn out, the drawn out cotton yarns are dispersed into single yarns through roller porcelain teeth, a yarn breaker and an enamel ring, and the single yarns are wound on a drum core through a groove drum;

e. Placing the prepared yarn cones on the computerized circular knitting machine and knitting the cotton yarns into a jeans wear through the computerized circular knitting machine.

In the embodiment VI, by adopting the design of the above processing steps, the computerized circular knitting machine is used for directly knitting the cotton yarns prepared as the yarn cones into a jeans wear without the processes of tailoring and sewing denim fabrics in the process of preparing the jeans wear, i.e. the production process of the jeans wear can be shortened effectively, and the material loss can be effectively reduced in the embodiment VI.

In the embodiment VII, a direct preparation process for jeans wear, characterized by comprising the following processing steps:

a. Settling cotton yarns through a fascicular warping machine to complete warping process, wherein the cotton yarns are wound in parallel with certain number and specified length of cotton yarns onto a warp beam, the tension and density distribution of the warp yarns are uniform, and the warping speed is 160 m/min;

b. Feeding the cotton yarns after the completion of the warping into a dyeing machine to carry out indigo blue dyeing, wherein oxygen bleaching or yarn boiling on the cotton yarns are performed before the indigo blue dyeing, the cotton yarns are placed into a dye for dyeing after the preprocessing, and the dye consists of indigo powder, sodium hydrosulfite, caustic soda and water, wherein the weight ratio of the indigo powder to the sodium hydrosulfite to the caustic soda is 1: 0.8: 0.7, and the dye comprises the four materials in parts by weight: 4% of indigo powder, 3.2% of sodium hydrosulfite, 2.8% of caustic soda and the allowance of water;

c. Feeding the cotton yarns after the completion of the indigo blue dyeing into a leaser to divide the cotton yarns, wherein the cotton yarns after the completion of the indigo blue dyeing are fed into the leaser through a porcelain cover of the leaser, the tension of the cotton yarns are adjusted through a tension adjuster of the leaser to meet the requirement of different numbers of cotton yarns, the cotton yarns are dispersed into flaky yarns to enter a head-piece of the leaser through the multiple twisting of a roller and the shaking of a guide wheel set, and the head-piece of the leaser is used for dividing the flaky yarns into single yarns through a reed.

d. Feeding the divided cotton yarns into the axle cone maker and making the cotton yarns into yarn cones through the axle cone maker, wherein the divided cotton yarns are wound on a radial axis, the radial axis is fed into the axle cone maker and the cotton yarns are drawn out, the drawn out cotton yarns are dispersed into single yarns through roller porcelain teeth, a yarn breaker and an enamel ring, and the single yarns are wound on a drum core through a groove drum;

e. Placing the prepared yarn cones on the computerized circular knitting machine, and knitting the cotton yarns into a jeans wear through the computerized circular knitting machine.

In the embodiment VII, by adopting the design of the above processing steps, the computerized circular knitting machine is used for directly knitting the cotton yarns prepared as the yarn cones into a jeans wear without the processes of tailoring and sewing denim fabrics in the process of preparing the jeans wear, i.e. the production process of the jeans wear can be shortened effectively, and the material loss can be effectively reduced in the embodiment VII.

In the embodiment VIII, a direct preparation process for jeans wear, characterized by comprising the following processing steps:

a. Settling cotton yarns through a fascicular warping machine to complete warping process, wherein the cotton yarns are wound in parallel with certain number and specified length of cotton yarns onto a warp beam, the tension and density distribution of the warp yarns are uniform, and the warping speed is 170 m/min;

b. Feeding the cotton yarns after the completion of the warping into a dyeing machine to carry out indigo blue dyeing, wherein oxygen bleaching or yarn boiling on the cotton yarns are performed before the indigo blue dyeing, the cotton yarns are placed into a dye for dyeing after the preprocessing, and the dye consists of indigo powder, sodium hydrosulfite, caustic soda and water, wherein the weight ratio of the indigo powder to the sodium hydrosulfite to the caustic soda is 1: 0.8: 0.7, and the dye comprises the four materials in parts by weight: 1% of indigo powder, 0.8% of sodium hydrosulfite, 0.7% of caustic soda and the allowance of water;

c. Feeding the cotton yarns after the completion of the indigo blue dyeing into a leaser to divide the cotton yarns, wherein the cotton yarns after the completion of the indigo blue dyeing are fed into the leaser through a porcelain cover of the leaser, the tension of the cotton yarns are adjusted through a tension adjuster of the leaser to meet the requirement of different numbers of cotton yarns, the cotton yarns are dispersed into flaky yarns to enter a head-piece of the leaser through the multiple twisting of a roller and the shaking of a guide wheel set, and the head-piece of the leaser is used for dividing the flaky yarns into single yarns through a reed.

d. Feeding the divided cotton yarns into the axle cone maker and making the cotton yarns into yarn cones through the axle cone maker, wherein the divided cotton yarns are wound on a radial axis, the radial axis is fed into the axle cone maker and the cotton yarns are drawn out, the drawn out cotton yarns are dispersed into single yarns through roller porcelain teeth, a yarn breaker and an enamel ring, and the single yarns are wound on a drum core through a groove drum;

e. Placing the prepared yarn cones on the computerized circular knitting machine, and knitting the cotton yarns into a jeans wear through the computerized circular knitting machine.

In the embodiment VIII, by adopting the design of the above processing steps, the computerized circular knitting machine is used for directly knitting the cotton yarns prepared as the yarn cones into a jeans wear without the processes of tailoring and sewing denim fabrics in the process of preparing the jeans wear, i.e. the production process of the jeans wear can be shortened effectively, and the material loss can be effectively reduced in the embodiment VIII.

In the embodiment IX, a direct preparation process for jeans wear, characterized by comprising the following processing steps:

a. Settling cotton yarns through a fascicular warping machine to complete warping process, wherein the cotton yarns are wound in parallel with certain number and specified length of cotton yarns onto a warp beam, the tension and density distribution of the warp yarns are uniform, and the warping speed is 180 m/min;

b. Feeding the cotton yarns after the completion of the warping into a dyeing machine to carry out indigo blue dyeing, wherein oxygen bleaching or yarn boiling on the cotton yarns are performed before the indigo blue dyeing, the cotton yarns are placed into a dye for dyeing after the preprocessing, and the dye consists of indigo powder, sodium hydrosulfite, caustic soda and water, wherein the weight ratio of the indigo powder to the sodium hydrosulfite to the caustic soda is 1: 0.8: 0.7, and the dye comprises the four materials in parts by weight: 6% of indigo powder, 4.8% of sodium hydrosulfite, 4.2% of caustic soda and the allowance of water;

c. Feeding the cotton yarns after the completion of the indigo blue dyeing into a leaser to divide the cotton yarns, wherein the cotton yarns after the completion of the indigo blue dyeing are fed into the leaser through a porcelain cover of the leaser, the tension of the cotton yarns are adjusted through a tension adjuster of the leaser to meet the requirement of different numbers of cotton yarns, the cotton yarns are dispersed into flaky yarns to enter a head-piece of the leaser through the multiple twisting of a roller and the shaking of a guide wheel set, and the head-piece of the leaser is used for dividing the flaky yarns into single yarns through a reed.

d. Feeding the divided cotton yarns into the axle cone maker and making the cotton yarns into yarn cones through the axle cone maker, wherein the divided cotton yarns are wound on a radial axis, the radial axis is fed into the axle cone maker and the cotton yarns are drawn out, the drawn out cotton yarns are dispersed into single yarns through roller porcelain teeth, a yarn breaker and an enamel ring, and the single yarns are wound on a drum core through a groove drum;

e. Placing the prepared yarn cones on the computerized circular knitting machine, and knitting the cotton yarns into a jeans wear through the computerized circular knitting machine.

In the embodiment IX, by adopting the design of the above processing steps, the computerized circular knitting machine is used for directly knitting the cotton yarns prepared as the yarn cones into a jeans wear without the processes of tailoring and sewing denim fabrics in the process of preparing the jeans wear, i.e. the production process of the jeans wear can be shortened effectively, and the material loss can be effectively reduced in the embodiment IX.

In the embodiment X, a direct preparation process for jeans wear, characterized by comprising the following processing steps:

a. Settling cotton yarns through a fascicular warping machine to complete warping process, wherein the cotton yarns are wound in parallel with certain number and specified length of cotton yarns onto a warp beam, the tension and density distribution of the warp yarns are uniform, and the warping speed is 200 m/min;

b. Feeding the cotton yarns after the completion of the warping into a dyeing machine to carry out indigo blue dyeing, wherein oxygen bleaching or yarn boiling on the cotton yarns are performed before the indigo blue dyeing, the cotton yarns are placed into a dye for dyeing after the preprocessing, and the dye consists of indigo powder, sodium hydrosulfite, caustic soda and water, wherein the weight ratio of the indigo powder to the sodium hydrosulfite to the caustic soda is 1: 0.8: 0.7, and the dye comprises the four materials in parts by weight: 5% of indigo powder, 4% of sodium hydrosulfite, 3.5% of caustic soda and the allowance of water;

c. Feeding the cotton yarns after the completion of the indigo blue dyeing into a leaser to divide the cotton yarns, wherein the cotton yarns after the completion of the indigo blue dyeing are fed into the leaser through a porcelain cover of the leaser, the tension of the cotton yarns are adjusted through a tension adjuster of the leaser to meet the requirement of different numbers of cotton yarns, the cotton yarns are dispersed into flaky yarns to enter a head-piece of the leaser through the multiple twisting of a roller and the shaking of a guide wheel set, and the head-piece of the leaser is used for dividing the flaky yarns into single yarns through a reed.

d. Feeding the divided cotton yarns into the axle cone maker and making the cotton yarns into yarn cones through the axle cone maker, wherein the divided cotton yarns are wound on a radial axis, the radial axis is fed into the axle cone maker and the cotton yarns are drawn out, the drawn out cotton yarns are dispersed into single yarns through roller porcelain teeth, a yarn breaker and an enamel ring, and the single yarns are wound on a drum core through a groove drum;

e. Placing the prepared yarn cones on the computerized circular knitting machine, and knitting the cotton yarns into a jeans wear through the computerized circular knitting machine.

In the embodiment X, by adopting the design of the above processing steps, the computerized circular knitting machine is used for directly knitting the cotton yarns prepared as the yarn cones into a jeans wear without the processes of tailoring and sewing denim fabrics in the process of preparing the jeans wear, i.e. the production process of the jeans wear can be shortened effectively, and the material loss can be effectively reduced in the embodiment X.

The above contents are the better embodiments of the invention only. For those skilled in this field, the embodiments and application scopes can be changed according to the idea of the invention. The content of the invention is not intended to be understood as the limitation to the invention.

What is claimed is:

1. A direct preparation process for jeans wear, comprising the following processing steps:

a. settling cotton yarns through a fascicular warping machine to complete warping process, wherein the cotton yarns between 200 and 1000 in number and between 500 and 2000 meters long are wound in parallel, tension and density distribution of the warped cotton yarns are uniform, and a warping speed is between 150 meters per minute and 200 meters per minute;

b. feeding the cotton yarns after completion of the warping process into a dyeing machine to carry out indigo blue dyeing, wherein oxygen bleaching or yarn boiling on the cotton yarns are performed before the indigo blue dyeing, the cotton yarns are placed Into a dye for dyeing after preprocessing, and the dye consists of Indigo powder, sodium hydrosulfite, caustic soda and water, c. feeding the cotton yarns after completion of the indigo blue dyeing into a leaser to divide the cotton yarns, wherein the cotton yarns after completion of the indigo blue dyeing are fed into the leaser through a porcelain cover of the leaser, tension of the cotton yarns are adjusted through a tension adjuster of the leaser, the cotton yarns are dispersed into flaky yarns to enter a head-piece of the leaser through multiple twisting of a roller and shaking of a guide wheel set, and the head-piece of the leaser divides the flaky yarns into single yarns;

d. feeding the divided cotton yarns into an axle cone maker and making the cotton yarns into yarn cones through the axle cone maker, wherein the divided cotton yarns are wound on a radial axis, the radial axis is fed into the axle cone maker and the cotton yarns are drawn out, the drawn out cotton yarns are dispersed into single yarns through roller porcelain teeth, a yarn breaker and an enamel ring, and the single yarns are wound on a drum core through a groove drum;

e. placing the prepared yarn cones on an automatic knitting machine, and knitting the cotton yarns into a jeans wear through the automatic knitting machine.

2. The direct preparation process for the jeans wear according to claim 1, wherein the automatic knitting machine is a computerized flat knitter.

3. The direct preparation process for the jeans wear according to claim 1, wherein the automatic knitting machine is a computerized circular knitting machine.

4. The direct preparation process for the jeans wear according to claim 1, wherein a weight ratio of the indigo powder to the sodium hydrosulfite to the caustic soda is 1: 0.8: 0.7.

5. The direct preparation process for the jeans wear according to claim 4, wherein in step b, the indigo powder comprises 1 to 6 parts by weight of the dye, the sodium hydrosulfite comprises 0.8 to 4.8 parts by weight of the dye, the caustic soda comprises 0.7 to 4.2 parts by weight of the dye, and the water comprises remaining parts by weight of the dye.

6. The direct preparation process for the jeans wear according to claim 5, wherein the indigo powder comprises 2 to 5 parts by weight of the dye, the sodium hydrosulfite comprises 1.6 to 4 parts by weight of the dye, the caustic soda comprises 1.4 to 3.5 parts by weight of the dye, and the water comprises remaining parts by weight of the dye.

7. The direct preparation process for the jeans wear according to claim 5, wherein the indigo powder comprises 3 to 4 parts by weight of the dye, the sodium hydrosulfite comprises 2.4 to 3.2 parts by weight of the dye the caustic soda comprises 2.1 to 2.8 parts by weight of the dye, and the water comprises remaining parts by weight of the dye.

8. The direct preparation process for the jeans wear according to claim 7, wherein the indigo powder comprises 3.5 parts by weight of the dye, the sodium hydrosulfite comprises 2.8 parts by weight of the dye, the caustic soda comprises 2.45 parts by weight of the dye, and the water comprises remaining parts by weight of the dye.

9. The direct preparation process for the jeans wear according to claim 7, wherein the indigo powder comprises 4 parts by weight of the dye, the sodium hydrosulfite comprises 3.2 parts by weight of the dye, the caustic soda comprises 2.8 parts by weight of the dye, and the water comprises remaining parts by weight of the dye.

10. The direct preparation process for the jeans wear according to any one of claims 1 to 9, wherein in step a, the cotton yarns wound in parallel are 1500 meters long and between 200 and 400 in number, and the warping speed is between 160 meters per minute and 180 meters per minute.

* * * * *